US006633235B1

(12) United States Patent
Hsu et al.

(10) Patent No.: US 6,633,235 B1
(45) **Date of Patent: *Oct. 14, 2003**

(54) METHOD AND APPARATUS FOR ALLOWING A PERSONAL COMPUTER TO CONTROL ONE OR MORE DEVICES

(75) Inventors: Liang-Hao Hsu, Hsinchu (TW); Chin-Hung Lin, Tainan (TW)

(73) Assignee: Winbond Electronics Corp. (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/526,572

(22) Filed: Mar. 16, 2000

Related U.S. Application Data

(63) Continuation-in-part of application No. 09/097,559, filed on Jun. 15, 1998, now Pat. No. 6,384,737.

(51) Int. Cl.[7] ..... G08C 19/00

(52) U.S. Cl. ..... 340/825.69; 340/825.72; 359/142; 700/12

(58) Field of Search ..... 340/825.69, 825.72; 700/12; 359/142, 174; 455/352

(56) References Cited

U.S. PATENT DOCUMENTS 5,109,222 A 4/1992 Welty 5,467,264 A 11/1995 Rauch et al.

*Primary Examiner*—Michael Horabik
*Assistant Examiner*—William Bangachon
(74) *Attorney, Agent, or Firm*—Raymond Sun

(57) ABSTRACT

A system is provided to allow a computer to control one or more devices using the remote control codes that are normally used by remote control units associated with these devices. The system has one or more remote control units for transmitting commands, one or more devices to be controlled, and a computer. The computer is coupled to an input device, and has a memory, a receiver which receives codes from the remote control units, and a knowledge base for storing the codes received from the remote control units and command identifiers provided from the input device. The knowledge base associates each command identifier with a particular code. The computer also includes a transmitter which transmits codes to the device to be controlled based on selected command identifiers. During configuration, the computer executes a program that prompts the user to enter a command identifier and code to be associated with that command identifier. The received code and its associated command identifier are stored in the knowledge base. During operation, a user enters a command identifier, and the program searches the knowledge base for the command identifier so as to locate the code corresponding to the command identifier. The program then transmits the code to the device to be controlled.

20 Claims, 12 Drawing Sheets

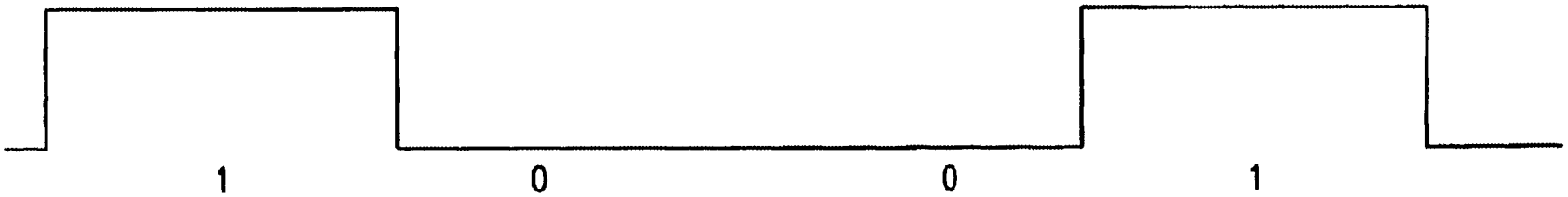
FIG. 6a
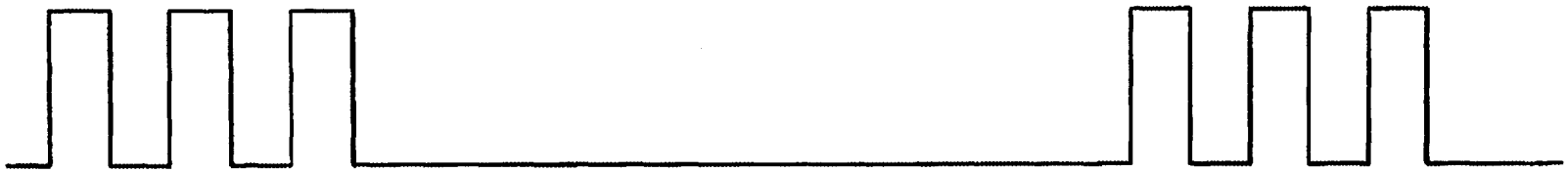
FIG. 6b
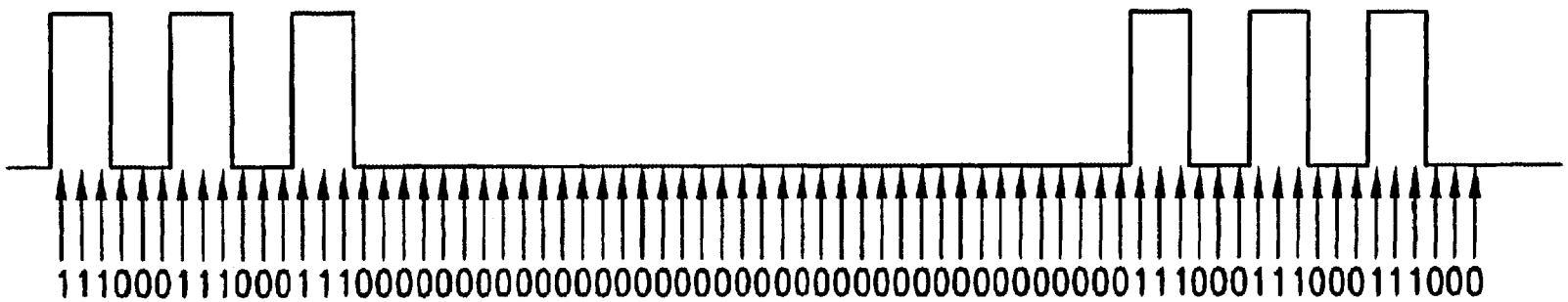
1110001110001110000000000

METHOD AND APPARATUS FOR ALLOWING A PERSONAL COMPUTER TO CONTROL ONE OR MORE DEVICES

RELATED APPLICATIONS

This is a continuation-in-part of Ser. No. 09/097,559, filed Jun. 15, 1998, entitled "Method and Apparatus for Allowing a Personal Computer to Control One or More Devices", now U.S. Pat. No. 6,384,737, whose disclosure is incorporated by this reference as though set forth fully herein.

BACKGROUND OF THE INVENTION

1. Field of the Invention

The present invention relates generally to wireless systems, and more specifically, to a method and apparatus for allowing a personal computer (PC) to directly or indirectly control one or more devices.

2. Description of the Prior Art

Conventional remote control systems include a remote control unit, which is typically a portable, hand-held unit, and a device to be controlled. The manufacturer of the device to be controlled provides the remote control unit for the convenience of the user. Accordingly, the device to be controlled and the remote control unit are configured to communicate with each other in a predetermined and pre-specified manner. This manner conforms to a protocol that governs the communication channel and the specific modulation or encoding scheme applied to the data that is communicated between the device to be controlled and the remote control unit.

With the proliferation of electronic devices, and in particular electronic devices that have remote control units corresponding thereto, it is quite common to find an average consumer having five to ten remote control units that each control different devices around the home. For example, it is common for a consumer to have a first remote control unit for controlling the television, a second remote control unit for controlling the video-cassette recorder (VCR), a third remote control unit for controlling the cable set-top box, a fourth remote control unit for controlling a stereo system, a fifth remote control unit for controlling a compact disc (CD) player, and possibly further remote control units for selectively controlling individual devices in the stereo system. A sixth remote control unit may be needed to control the air conditioning unit in the home, and yet a separate remote control unit may be needed to control the heating system in the home.

Moreover, because of the different communication channels and encoding schemes employed by the devices, a remote control device that is associated with a first device is limited in its ability to communicate with other devices. In this regard, it may be desirable to have a single remote control that controls a plurality of electronic devices. Moreover, it may be desirable to have a single command that in essence represents a plurality of commands to different devices to create a preferred environment for a particular user. For example, a user may desire to enter a room, and with a single push of a button on a remote control unit, have the following events occur: 1) room temperature adjusted to a particular preprogrammed temperature; 2) the television to turn on and tune to a pre-programmed station at a preset volume level; 3) the stereo to turn on and have the CD player play a pre-programmed selection of songs in a predetermined order and volume. Unfortunately, conventional devices and their associated remote control units are unable to provide such a function.

Based on the foregoing, there remains a need for a system and method for allowing a personal computer (PC) to control one or more devices.

SUMMARY OF THE INVENTION

It is an object of the present invention to provide a wireless interface controller that enables a personal computer to directly control a plurality of different devices that operate with different communication codes.

It is a further object of the present invention to provide a wireless interface controller that enables a personal computer to directly control a plurality of different devices without employing the remote control units corresponding to these devices.

It is another object of the present invention to provide a wireless interface controller that enables a user to program a personal computer with a single button or command that, when activated, causes a particular device to perform more than one function.

It is yet another object of the present invention to provide a wireless interface controller that enables a user to program a personal computer with a single button or command that, when activated, sets an environment by causing two or more devices to each perform at least one function. In other words, the present invention allows a user to pre-program a single command that represents a plurality of different commands that can be directed at one or more different devices. In this way, the user can create a desired environment or a set of conditions with the touch of a single button.

It is yet a further object of the present invention to provide a wireless interface controller that enables a user to control one or more devices from a distant location via a phone or Internet link.

The objects of the present invention may be achieved by providing a system having one or more remote control units for transmitting commands, one or more devices to be controlled, and a computer. The computer is coupled to an input device, and has a memory, a receiver which receives codes from the remote control units, and a knowledge base for storing the codes received from the remote control units and command identifiers provided from the input device. The knowledge base associates each command identifier with a particular code. The computer also includes a transmitter which transmits codes to the device to be controlled based on selected command identifiers. During configuration, the computer executes a program that prompts the user to enter a command identifier and code to be associated with that command identifier. The received code and its associated command identifier are stored in the knowledge base. During operation, a user enters a command identifier, and the program searches the knowledge base for the command identifier so as to locate the code corresponding to the command identifier. The program then transmits the code to the device to be controlled. Thus, the present invention provides to the user a convenient and time-saving feature, as it obviates the need to locate a particular remote control unit to control a corresponding device. In an alternative embodiment, repeaters are provided to receive and re-transmit the codes from the computer so as to extend the effective range of the computer and to accommodate for the line-of-sight restrictions of conventional IR transmission.

In yet a further alternative embodiment, the computer is provided with an Internet card so that the user can use a distant computer to establish an Internet connection with the computer and to transmit the desired command identifier from the distant computer to cause the computer to control the device.

In yet another alternative embodiment, the computer is provided with a phone card so that the user can use a distant telephone to establish a phone link with the computer and to transmit the desired command identifier from the distant telephone to cause the computer to control the device.

BRIEF DESCRIPTION OF THE DRAWINGS

The present invention is illustrated by way of example, and not by way of limitation, in the figures of the accompanying drawings and in which like reference numerals refer to similar elements.

FIG. 6*a* is a waveform that represents an exemplary code generated by a remote control unit. FIG. 6*b* is a waveform that represents a carrier modulated by the exemplary code of FIG. 6*a*. FIG. 6*c* illustrates how an over-sampling method, employed by the present invention, is applied to the waveform of FIG. 6*b*.

DETAILED DESCRIPTION OF THE PREFERRED EMBODIMENT

A system and method for allowing a personal computer (PC) to control one or more devices are described. The PC can in turn be controlled by a user directly at the PC itself, or from a distant PC via an Internet link, or from a distant telephone via a phone card resident in the PC. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Figure 1:
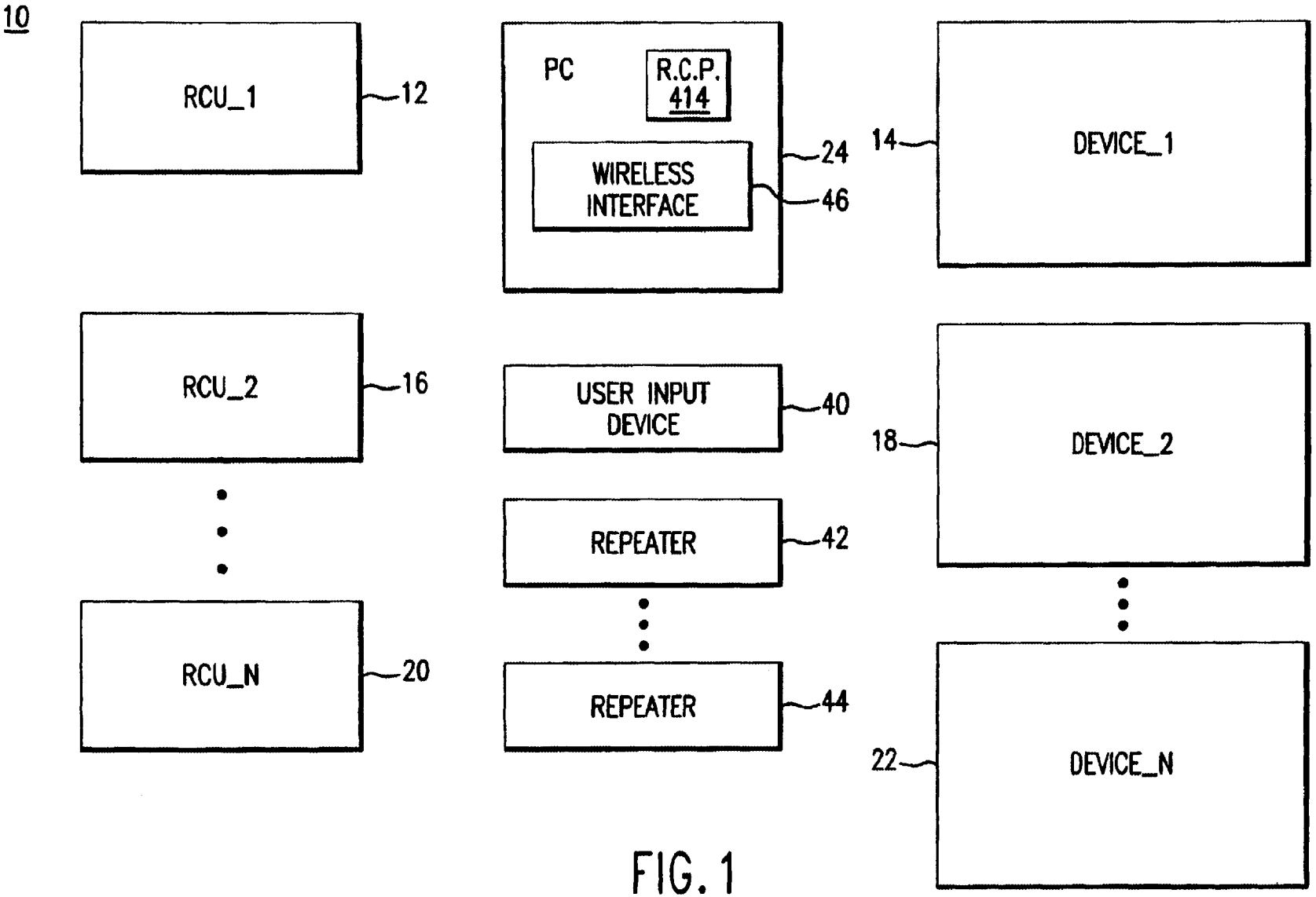
FIG. 1 is a block diagram of one embodiment of a system in which the present invention may be implemented.

FIG. 1 is a block diagram illustrating the components of a remote control system 10 in which the present invention may be implemented. The remote control system 10 includes: one or more remote control units (e.g., RCU_1 12, RCU_2 16 and RCU_N 20), a PC 24, and one or more devices to be controlled (e.g., Device_1 14, Device_2 18 and Device_N 22). In addition, a user input device 40 is coupled to the PC 24 and allows a user to input signals into the PC 24. The user input device 40 can include a keyboard having a plurality of keys. The user input device 40 can also include a cursor control device having a plurality of control buttons, a mouse, a joystick, a touchpad, or a track-ball device. PC 24 can be a computer system, or a processor, or a base unit that includes a processor. The system 10 can further include one or more repeaters 42 and 44 that can be used to extend the distance and direction of the codes described hereinbelow.

Figure 2:
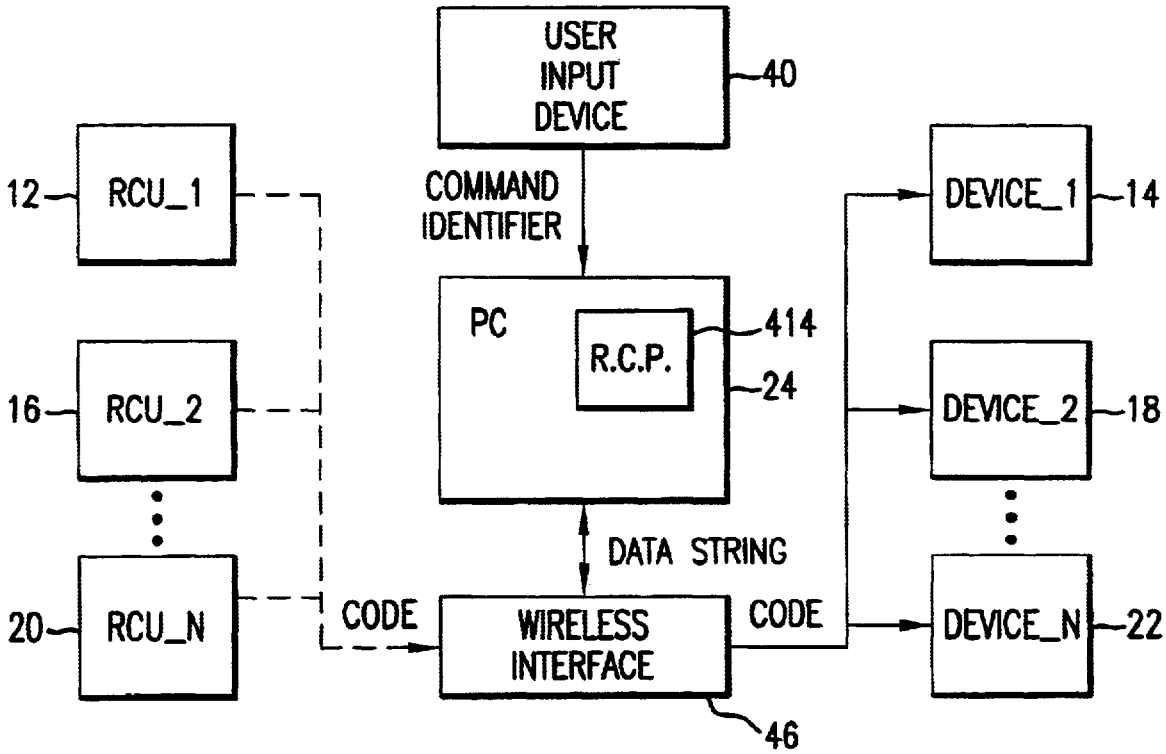
FIG. 2 is a block diagram illustrating the system of FIG. 1, configured in accordance with one embodiment of the present invention, that allows a personal computer to directly control devices.

FIG. 2 is a block diagram illustrating the system 10 of FIG. 1, configured in accordance with one embodiment of the present invention, that allows the PC 24 to directly control certain devices 14, 18, 22. Before the PC 24 can be employed to control a certain device, the codes for that device must first be programmed into the PC 24. A code is simply an instruction or command which is understandable to a device 14, 18, 22 to be controlled and which causes that device to perform a particular function. Once the PC 24 has been programmed with codes for a particular device, the PC 24 can be employed by the user to control that device. The remote control units 12, 16, 20 are employed to provide codes to the PC 24. Each code is stored in a knowledge base 714, and associated with a user-defined command identifier, as described in greater detail hereinafter in connection with FIG. 8. Once the PC 24 is configured or programmed, the user can control one or more of the devices 14, 18, 22 with the PC 24 via the command identifiers, as described in greater detail in connection with FIG. 9. The command identifiers are used to identify a desired device 14, 18, 22 and one or more device functions to be performed by that device 14, 18 or 22.

A wireless interface 46 is coupled to the PC 24 to receive the codes from the remote control units 12, 16, 20, and to transmit the codes to devices to be controlled 14, 18 and 22. The wireless interface 46 includes an infrared (IR) transmitter for transmitting codes and an IR receiver for receiving codes. In this embodiment, the wireless interface 46 is housed in a device that is external to the PC 24 and is coupled to the PC 24 by a wire or cable. In use, codes may be transmitted to the IR receiver of the wireless interface 46 by pointing the remote control unit 12, 16 or 20 at the IR receiver, and codes may be transmitted from the IR transmitter of the wireless interface 46 by lifting the wireless interface 46 and pointing the IR transmitter of the wireless interface 46 at the device 14, 18 or 22 to be controlled.

The PC 24 can also be pre-programmed to automatically transmit certain codes at predetermined times. For example, one can pre-program the PC 24 to automatically transmit a first code at a prespecified time in the evening to turn on the heater and a second code at a wake-up time in the morning to turn on the stereo system.

Figure 5:
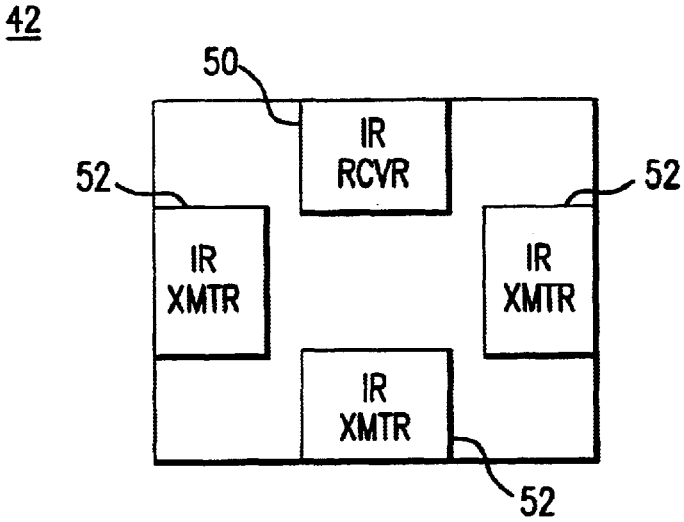
FIG. 5 is a block diagram illustrating in greater detail the repeater of FIG. 3.
Figure 3:
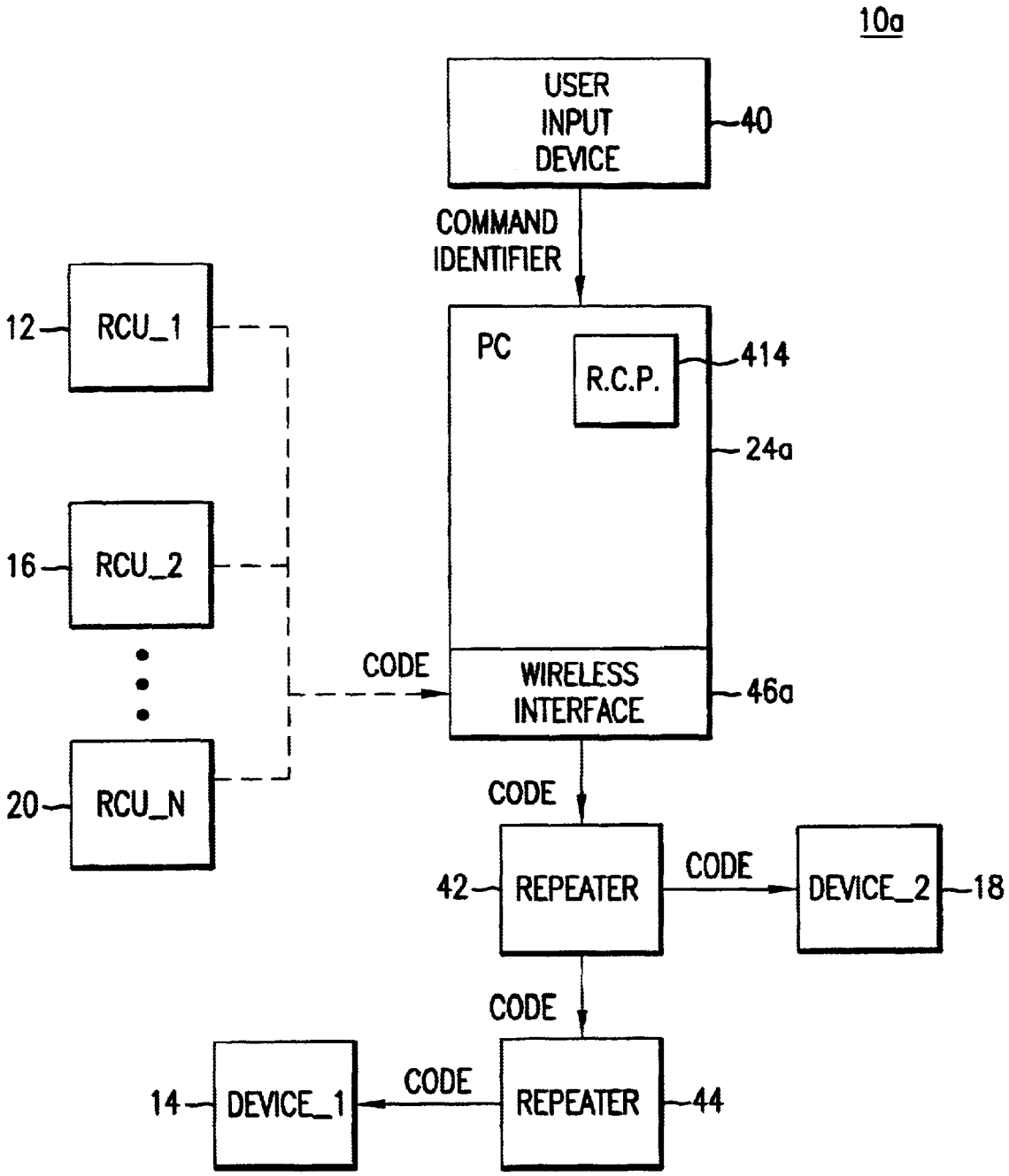
FIG. 3 is a block diagram illustrating the system of FIG. 2, configured in accordance with a second embodiment of the present invention, that allows a personal computer to control devices via one or more repeaters.

FIG. 3 is a block diagram illustrating the system of FIG. 2, configured with one or more repeaters 42, 44 that allow the range and direction of the wireless interface 46 to be extended to control devices 14, 18. Referring to FIG. 3, the system 10*a* is essentially the same as system 10 of FIG. 2, except that the wireless interface 46*a* is co-located in the PC 24*a*, and whose position and direction of transmission is therefore fixed. The wireless interface 46*a* also includes an IR transmitter for transmitting codes and an IR receiver for receiving codes. The system 10*a* additionally provides two repeaters 42 and 44, each of which has an IR receiver 50 and one or more IR transmitters 52, as shown in FIG. 5. Each IR transmitter 52 can be oriented to transmit IR signals at different directions. In the system 10*a,* the first repeater 42 is positioned to receive codes from the interface 46*a,* and to re-transmit the received codes in two separate directions, to a device 18, and to the second repeater 44. The second repeater 44 is positioned to receive codes from the first repeater 42, and to re-transmit the received codes to another device 14.

In use, codes may be transmitted to the IR receiver of the interface 46*a* by pointing the remote control unit 12, 16 or 20 at the IR receiver, but the codes can only be emitted from the IR transmitter in a line-of-sight manner. This is a restriction that is imposed by the use of infrared signals, since infrared signals can only travel in a straight line (i.e., line-of-sight) manner and cannot radiate in different directions. However, the use of the repeaters 42, 44 allow codes that are emitted from the IR transmitter of the interface 46*a* in a straight line to be redirected in different directions to control devices 14, 18 located in different locations around a room or given space. In addition, the repeaters 42, 44 can also be used to extend the distance or range of the codes emitted from the IR transmitter of the wireless interface 46*a*.

Figure 4:
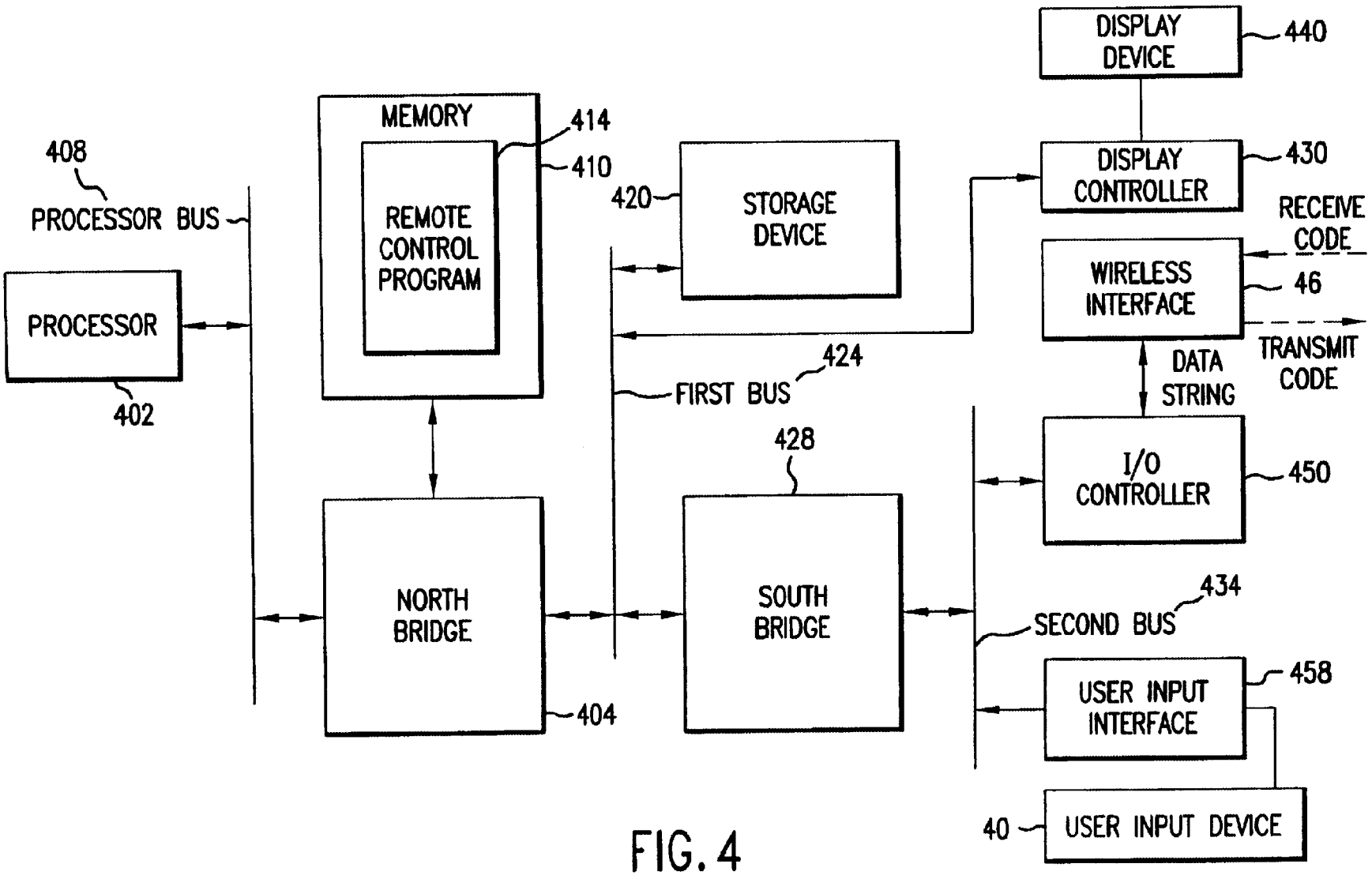
FIG. 4 is a block diagram illustrating in greater detail the personal computer of FIG. 1.

FIG. 4 illustrates in greater detail relevant components of the PC 24. The PC 24 includes a processor 402 coupled to a north bridge 404 via a processor bus 408. A memory 410 is coupled to the north bridge 404. The north bridge 404 provides an interface between the processor bus 408 and a first bus 424, which may be a PCI bus, and also controls access to the memory 410. The memory 410 includes a remote control program 414 of the present invention which is described in greater detail hereinafter with reference to FIG. 7.

A storage device 420 (which may be a hard drive), a display controller 430, and a south bridge 428 are coupled to the first bus 424. The display controller 430 supports a display device 440, which can be used to prompt a user for input (e.g., command identifiers) as described hereinafter. The south bridge 428 provides an interface between the first bus 424 and a second bus 434, which may be an ISA bus. A user input interface 458 is coupled to the second bus 434 and supports the user input device 40. As noted earlier, the user input device 40 can be employed to provide command identifiers to the PC 24. An I/O controller 450 is coupled to the second bus 434 and interfaces with the wireless interface 46 or 46*a* which was described in greater detail hereinabove. The I/O controller 450 can be used to perform over-sampling of the codes to generate associated data strings, as described below. Alternatively, the wireless interface 46, 46*a* can be used to convert codes to data strings and vice-versa.

FIG. 6*a* is a waveform that represents an exemplary code generated by a remote control unit. FIG. 6*b* is a waveform that represents a carrier modulated by the exemplary code of FIG. 6*a*. FIG. 6*c* illustrates how an over-sampling method, employed by the present invention, is applied to the waveform of FIG. 6*b*. Briefly, each remote control unit 12, 16, 20 employs a code to modulate a carrier. The modulated carrier is sampled and compressed into a data string representative of the code. The data string is subsequently assigned to a command identifier as described in connection with FIG. 8. Because remote control units 12, 16, 20 employ different frequencies and different encoding schemes to transmit signals, the inventors have developed a novel method and apparatus for efficiently processing and storing the received codes from the remote control units 12, 16, 20. This novel method and apparatus for processing the received commands is described in U.S. patent application Ser. No. 08/932,268, filed Sep. 17, 1997, and entitled, "Method and Apparatus for Controlling a Computer System by a Remote Controller," which is hereby incorporated by this reference as though fully set forth herein. The oversampling of FIG. 6(*c*) can be done either in hardware or in software. If done in hardware, the oversampling is performed by the I/O controller 450. If done in software, the oversampling is performed by a program in the memory 410.

Figure 7:
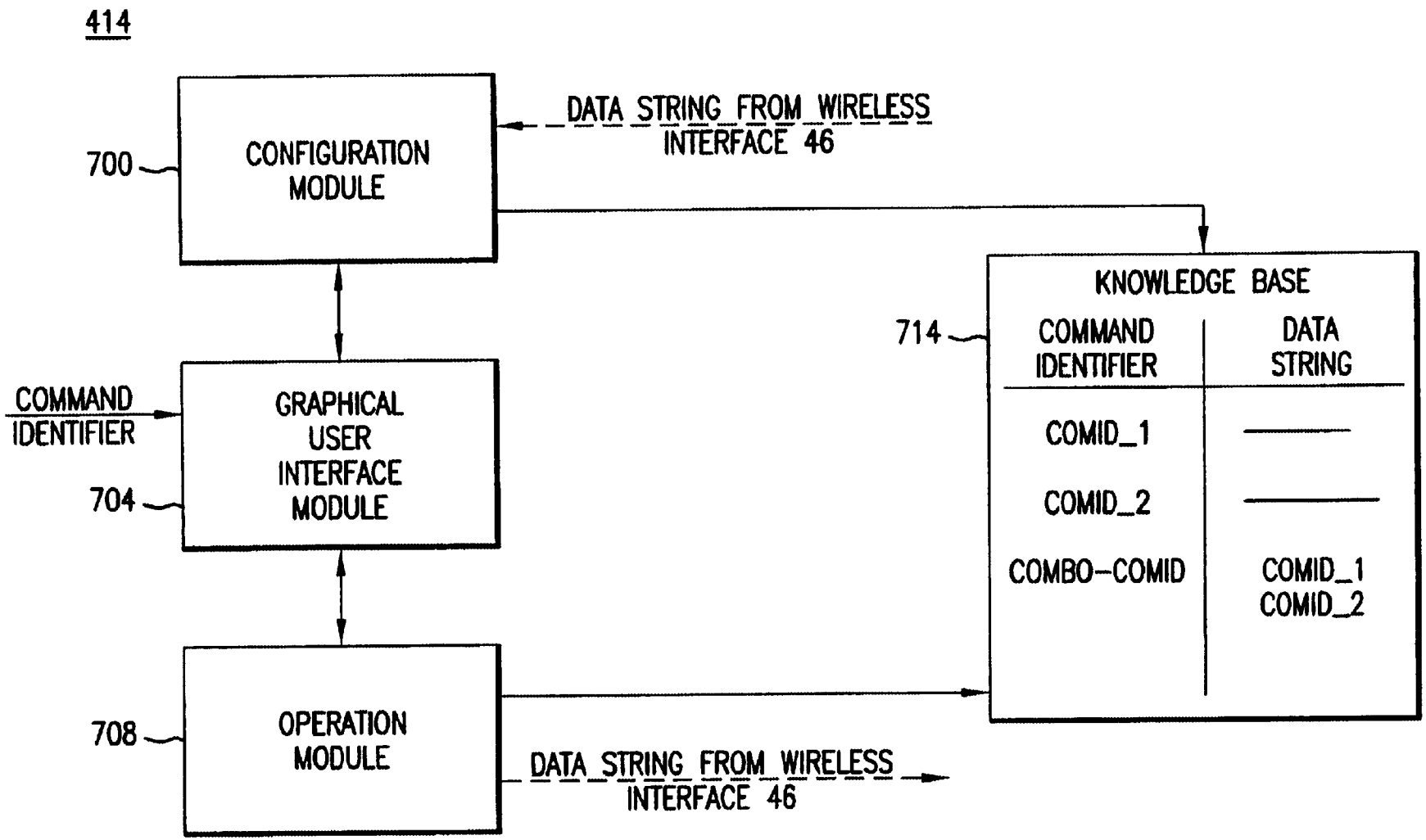
FIG. 7 illustrates in greater detail the remote control program of FIG. 4.

FIG. 7 illustrates in greater detail the remote control program 414 of FIG. 4. The remote control program 414 includes a configuration module 700 and an operation module 708 that both employ a graphical user interface module (GUI) 704 to receive input from a user. The configuration module 700 configures or programs the PC 24 so that the PC 24 can be used to control other devices 14, 18, 22, as will be described in greater detail hereinafter with reference to FIG. 8. The operation module 708 manages the remote control features of the PC 24 so that upon receipt of a command identifier from the user, the PC 24 can transmit a corresponding code to devices 14, 18, 22, as will be described in greater detail hereinafter with reference to FIG. 9. The remote control program 414 also includes a knowledge base 714 that associates a command identifier with a data string.

The GUI module 704 receives user inputs (e.g., the command identifiers) and provides the user with prompts and instructions. In addition, the GUI 704 receives the codes from the remote control units 12, 16, 20 and provides these codes to the knowledge base 714 via the configuration module 700. The GUI module 704 also provides the codes from the knowledge base 714 (via the operation module 708) to the I/O controller 450 for transmission to the devices 14, 18, 22.

The user can also define a command identifier to correspond to one or more data strings thereby allowing the user to control one or more functions on one or more devices. For example, consider the example, where there are two devices to be controlled: 1) an air-conditioner, and 2) an audio compact disc (CD) player. Table I illustrates a table that associates a command from a particular remote control unit 12, 16, 20 to a function on a device to be controlled. Table II illustrates a table that associates a command from a particular remote control unit 12, 16, 20 to one or more functions on one or more devices to be controlled.

TABLE I

| COMMAND IDENTIFIER | FUNCTIONAL DESCRIPTION |
|---|---|
| power_1 | turn on air conditioner |
| dn_1_degree | turn AC dn_1_degree |
| power_2 | turn on CD player |
| CD | select CD function |
| playCD | play CD player |
| next_song | play next_song |

TABLE II

| COMBINATION IDENTIFIER | PREVIOUSLY DEFINED COMMAND IDENTIFIER |
|---|---|
| My_favorite | power_1 |
| | dn_1_degree |
| | dn_1 degree |
| | power_2 |
| | CD |
| | playCD |

TABLE II-continued

| COMBINATION IDENTIFIER | PREVIOUSLY DEFINED COMMAND IDENTIFIER |
|---|---|
| | next_song |
| | next_song |

In the following example, a combination command identifier allows the user to adjust the room temperature and play two favorite songs on a CD player. Given a current environment where the air conditioner is set to 27 degrees Celsius and the audio CD player is off, if a user selects the combination command identifier "My_favorite", the PC 24 performs the following:

1. transmit "power_1 signal" so that the air conditioner turns on;
2. transmit "down-one-degree" signal so that the air conditioner setting changes to 26 degrees;
3. transmit "down-one-degree" signal so that the air conditioner setting changes to 25 degrees;
4. transmit "power_2 signal" so that the audio CD player turns on;
5. transmit "CD signal" so that the CD player selects the CD function;
6. transmit "play_CD" signal so that the CD player plays the CD;
7. transmit "play_next_song" signal so that the CD player plays the second song on the CD;
8. transmit "play_next_song" signal so that the CD player plays the third song on the CD.

The graphical user interface (GUI) 704, employed by the present invention to prompt the user for input, can be implemented as part of the driver program, as part of the operating system (OS), or separately as an application, running on top of the OS.

The operation of the systems 10 and 10*a* will now be described. In order to use the PC 24 to remotely control the devices 14, 18, 22, the PC 24 must first be "trained" or programmed to associate certain user defined command identifiers with specific codes (referred to hereinafter as the "configuration mode"). Thereafter, the PC 24 can be used to control the devices 14, 18, 22 based on the command identifiers (referred to hereinafter as the "operation mode"). In the configuration mode, the PC 24 is programmed with the codes for the devices 14, 18, or 22 to be controlled. A user points a remote control unit 12, 16, 20 at the IR receiver of the wireless interface 46 and activates a button (or presses a key) on the remote control unit 12, 16, 20. The remote control unit 12, 16, 20 transmits to the PC 24 a code that is understandable by the device 14, 18, or 22 to be controlled. The PC 24 then samples the received code, converts the code into a data string, and assigns the data string to a user defined command identifier. The command identifiers can then be employed by the user to remotely control devices with the PC 24. For example, the user can select a command identifier from a pull-down menu by employing a hardware or software button or key. As described above, the configuration module 700 and the graphical user interface module 704 are used in the configuration mode, and the operation module 708 and the graphical user interface module 704 are used in the operation mode.

Figure 8:
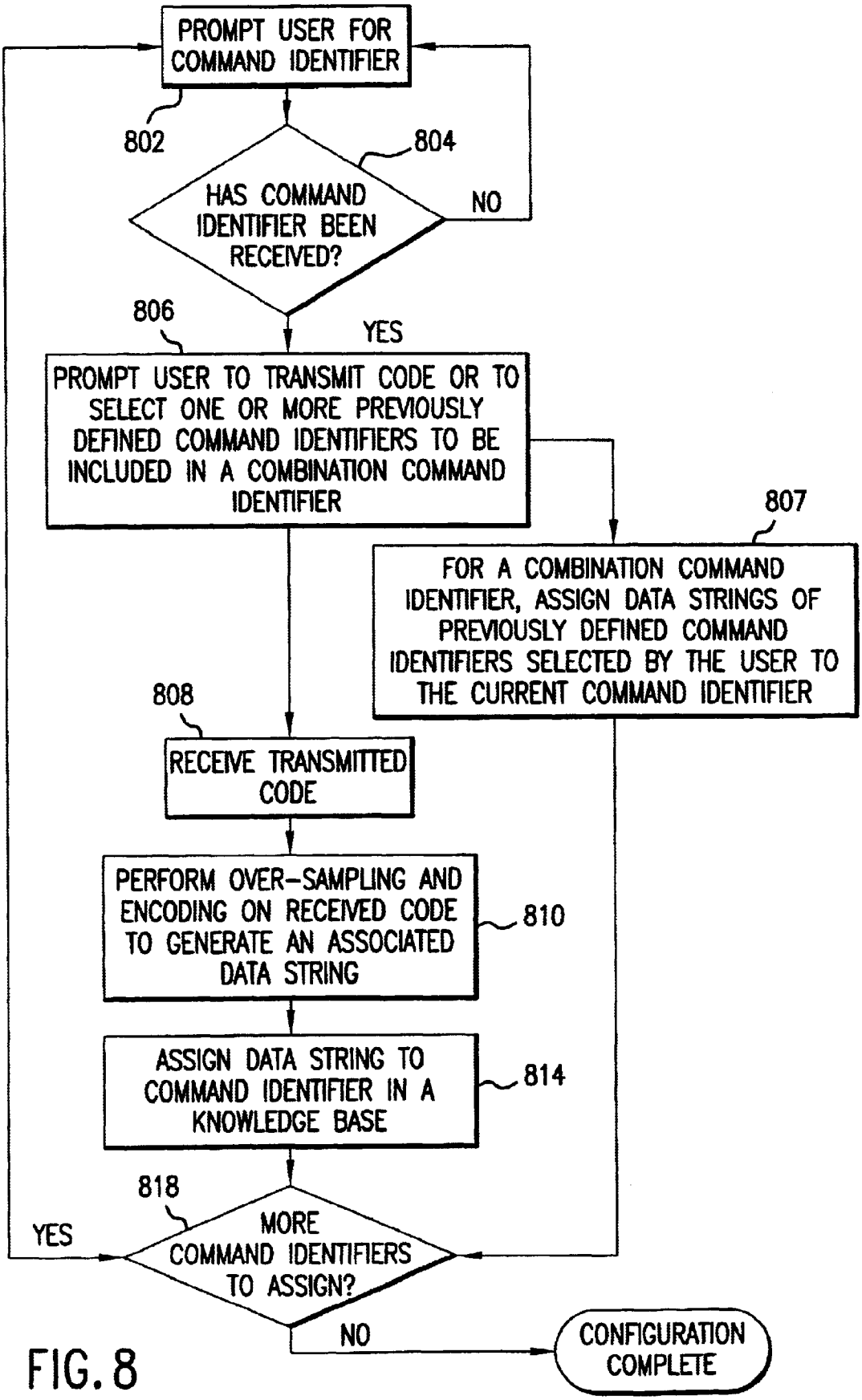
FIG. 8 is a flow chart illustrating the processing steps involved in configuring the personal computer.

FIG. 8 is a flow chart illustrating the processing steps involved in configuring the PC 24 in either system 10 or 10*a*. In step 802, the graphical user interface 704 prompts the user for a command identifier. As explained previously, a data string is a compressed version of the code that conserves storage space, and the wireless interface 46 converts a data string to an associated code and vice-versa. As will be explained hereinafter, the command identifier can also identify one or more previously defined command identifiers. A command identifier that identifies one or more previously defined command identifiers is the combination command identifier described above.

In step 804, a determination is made as to whether a command identifier has been received. If no command identifier has been received, processing returns to step 802 to prompt the user again. It is important that each command identifier uniquely identifies one or more data strings so that a user can unambiguously control one or more devices and device functions. In this regard, the flowchart of FIG. 8 can be modified to check whether the received command identifier is unique (i.e., whether an identical command identifier has been previously defined). For example, if the user enters a non-unique command identifier, the GUI 704 can display a message notifying the user that the inputted command identifier has already been defined and asking the user for another identifier. This check can be inserted between steps 804 and 806. If such a check is implemented, a unique command identifier is assured at step 806.

If a command identifier has been received, in step 806, the graphical user interface 704 prompts the user to employ a remote control device to either (1) provide a code (i.e., an instruction or command, which when received by the device to be controlled, directs the device to perform the function), or (2) to create a "combination" command identifier (i.e., a command identifier that includes one or more other previously defined command identifiers) by selecting one or more previously defined identifiers. If the user provides a code, then in step 808, the transmitted code is received by the wireless interface 46. In step 810, the received code is over-sampled and encoded by the processor 402 (if done in software) or I/O controller 450 (if done in hardware) to generate a data string that is associated with the received code. In step 814, the data string is assigned to the command identifier and stored in knowledge base 714, and processing proceeds to step 818, where a determination is made as to whether the user wants to define another command identifier. If no, then processing is completed, otherwise, processing returns to step 802 to receive another command identifier.

If, at step 806, the user selects a previously defined identifier, then in step 807, the current command identifier is a combination command identifier, and data strings assigned to all previously defined identifiers selected by the user are assigned to the combination command identifier. Processing then proceeds to step 818. Thus, in this fashion, combination command identifiers that include one or more previously defined identifiers can be created. These combination identifiers are especially useful for setting an environment by setting a plurality of devices in a room or home to the preferences of an individual user.

Figure 9:
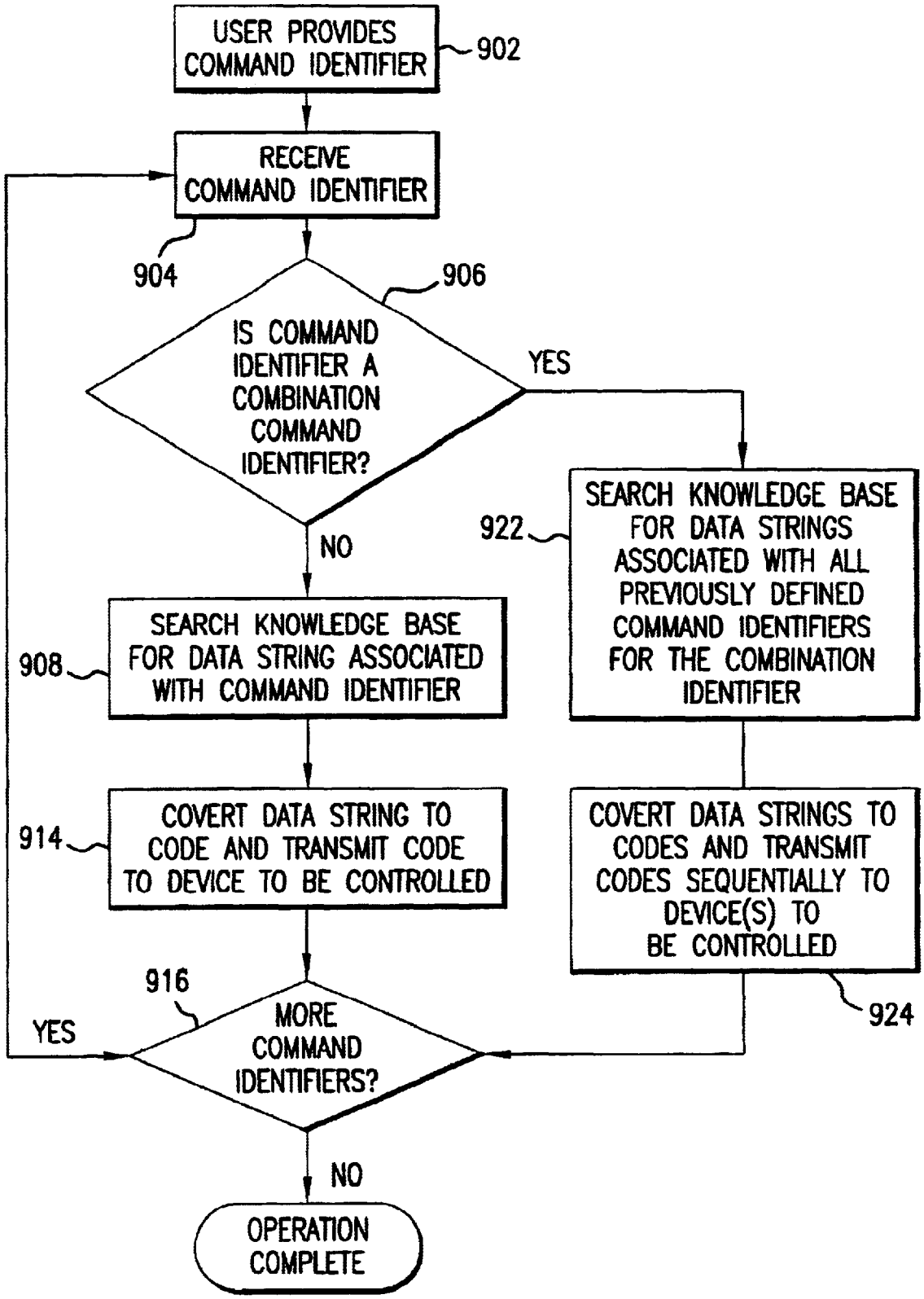
FIG. 9 is a flow chart illustrating the processing steps carried out by the system of FIG. 2 and FIG. 3.

FIG. 9 is a flow chart illustrating the processing steps carried out by the systems 10 and 10*a*. In step 902, a user provides a command identifier. In step 904, the command identifier is received via the graphical user interface module 704, and in step 906, a determination is made (via the operation module 708) as to whether the command identifier is a combination command identifier. If yes, processing proceeds through a left branch, defined by steps 908 and 914. If no, processing proceeds through a right branch, defined by steps. 922 and 924. In step 908, the operation module 708 searches the knowledge base 714 for a data string corresponding to the command identifier. In step 914, the wireless interface 46 (or I/O controller 450) converts the data string to a corresponding code and transmits the code to the device 14, 18, 22 to be controlled. In system 10, the code is transmitted directly to the device(s) 14, 18, 22 to be controlled, with the assistance of the user in pointing the wireless interface 46 at the device(s) 14, 18, 22 to create the line-of-sight necessary for the transmission of the IR code. In system 10*a*, the IR code is transmitted either directly to a device 14, 18 or 22, that is, in the direct line-of-sight of the IR transmitter of the wireless interface 46*a*, or to the repeater 42 for subsequent transmission to other devices 14, 18, 22 and/or repeaters (e.g., repeater 44).

In step 916, a determination is then made as to whether further command identifiers are provided. If no, then processing is complete, otherwise, processing returns to step 904 to receive another command identifier. If the determination in decision block 906 is yes (i.e., command identifier is a combination command identifier), then in step 922, the operation module 708 searches the knowledge base 714 for a data strings corresponding to all previously-defined command identifiers included in the combination command identifier. In step 924, the wireless interface 46 (or I/O controller 450) converts the data strings to corresponding codes and transmits each of the codes sequentially to the devices to be controlled. Processing then proceeds to step 916.

Figure 10:
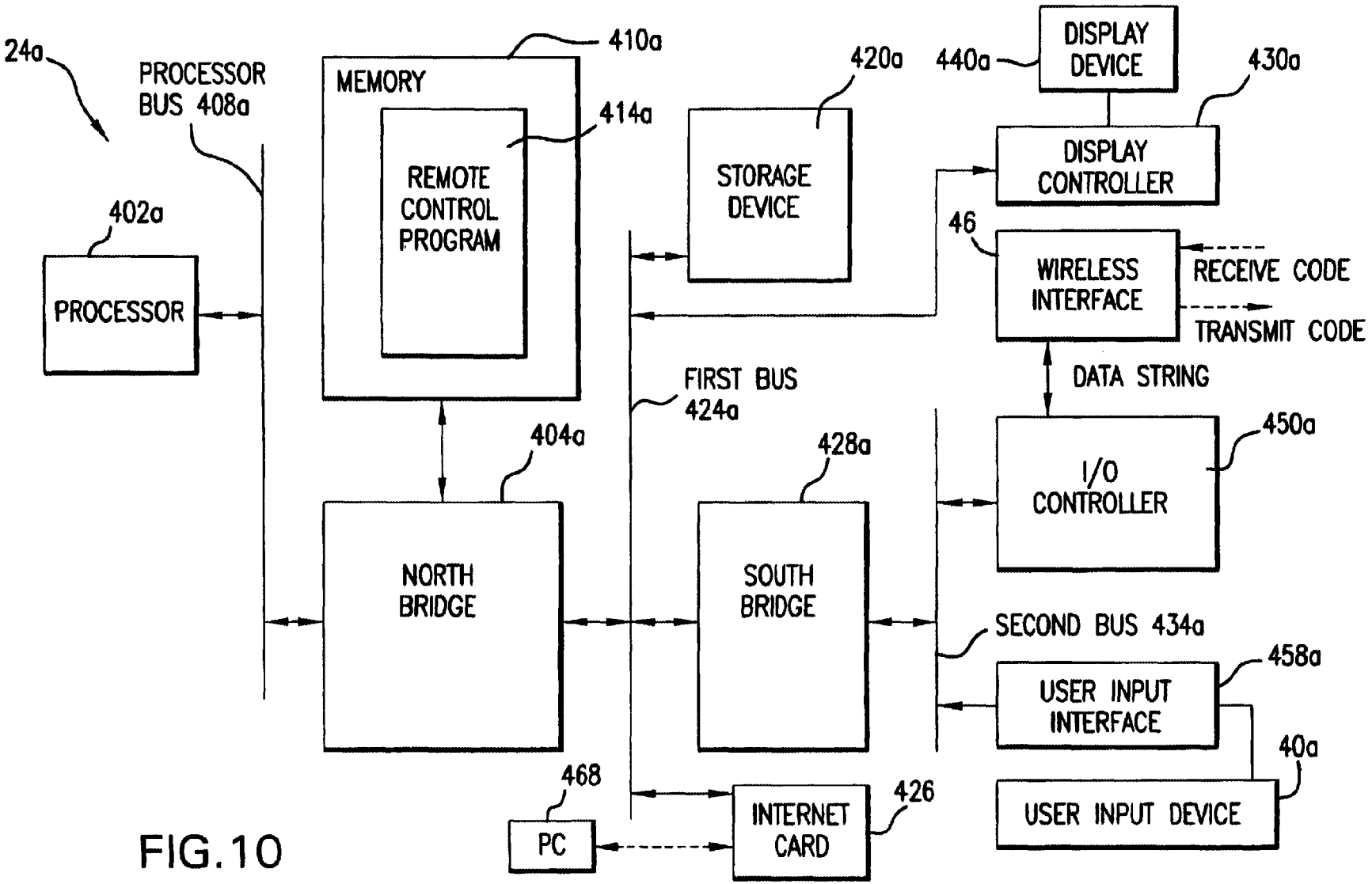
FIG. 10 is a block diagram of the personal computer of FIG. 4 illustrating a first modification thereto.
Figure 11:
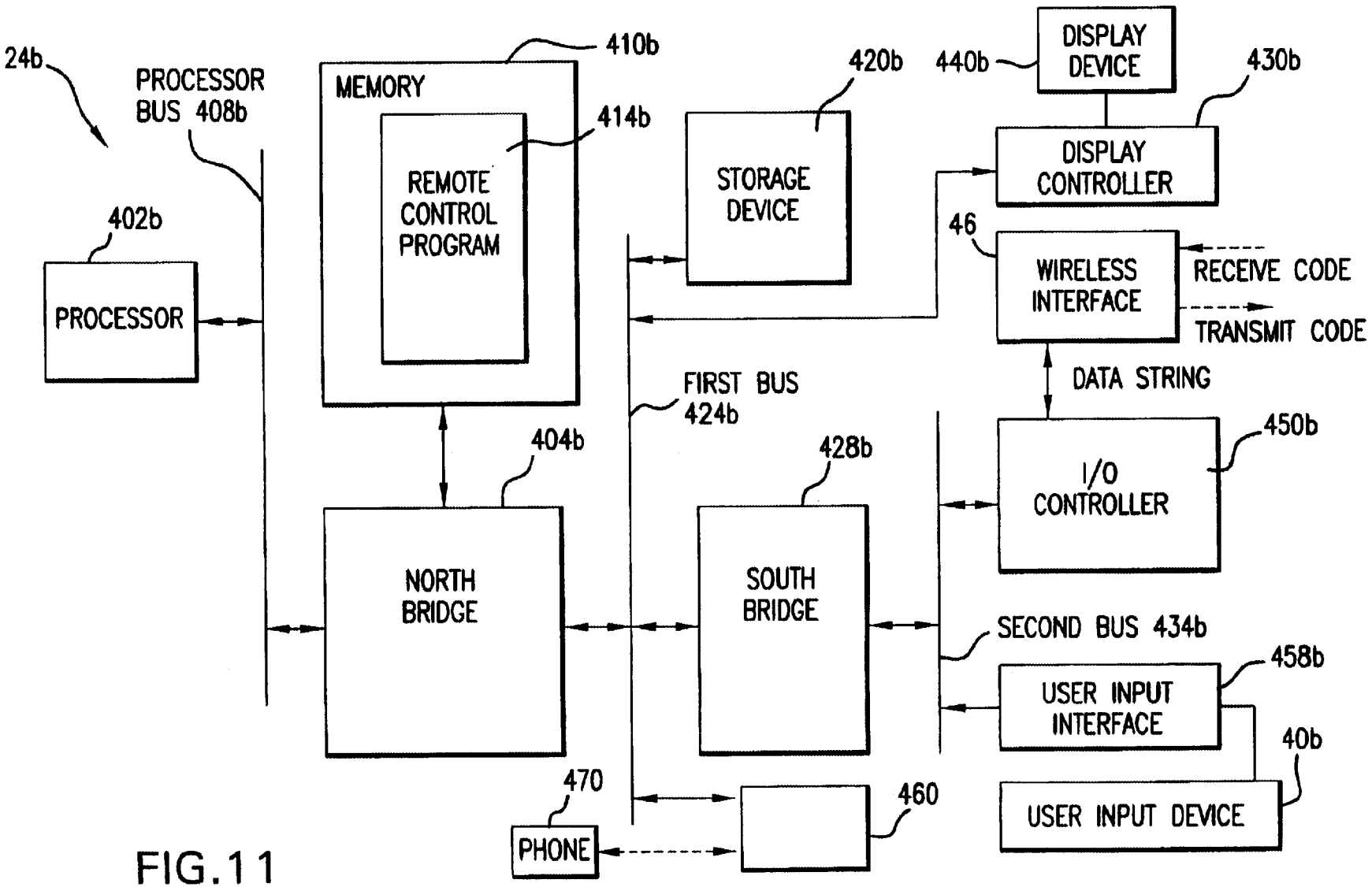
FIG. 11 is a block diagram of the personal computer of FIG. 4 illustrating a second modification thereto.

The present invention's flexibility is further illustrated in FIGS. 10 and 11 in which the user is able to control the devices 14, 18 and 22 of FIG. 1 from a distant location. FIG. 10 illustrates a first modification that can be made to the PC 24 of FIG. 4. The elements of the PC 24*a* in FIG. 10 that are the same as the elements of the PC 24 of FIG. 4 are provided with the same numeral designations except that an "a" has been added to the numeral designations in FIG. 10, and are not further described herein. The PC 24*a* is the same as PC 24 in FIG. 4 except that an Internet card 426 is also coupled to the first bus 424. The Internet card 426 can be a standard card that is used by a PC to interface with the Internet (i.e., receive signals from and transmit signals to an Internet provider). The PC 24*a* therefore allows the user to control the devices 14, 18 and 22 from a distant PC or computer system 468 using an Internet connection, as described below.

The operation and use of the PC 24*a* is similar to that of PC 24 in FIG. 4. In particular, the PC 24*a* can be "trained", configured or programmed using the same method described above in connection with FIG. 8 using the remote control units 12, 16, 20 and the wireless interface 46, 46*a*. For example, the user can use the command identifier "*1" to represent the recording of a program on a designated channel in a VCR. When the user is now outside the home and at a distant location, the user can cause the VCR to record the television program on that designated channel by providing a command identifier (see step 902 in FIG. 9). To do so, the user can use a distant PC or other computer system 468 to establish an Internet connection with the PC 24*a* (as described below). After the Internet connection between the distant PC 468 and the PC 24*a* has been established, the user enters the designated command identifier "*1" from the distant PC 468, and the signal for "*1" is transmitted via the Internet to the Internet card 426 of PC 24*a*, from which the PC 24*a* can process the signal. In this regard, the Internet card 426 operates in the same way as an input device (such as user input device 40) in receiving the command identifier (see step 904 in FIG. 9). The PC 24*a* then processes the received command identifier in the same manner as described in steps 906, 908, 914, 916, 922 and 924 of FIG. 9.

Figure 12:
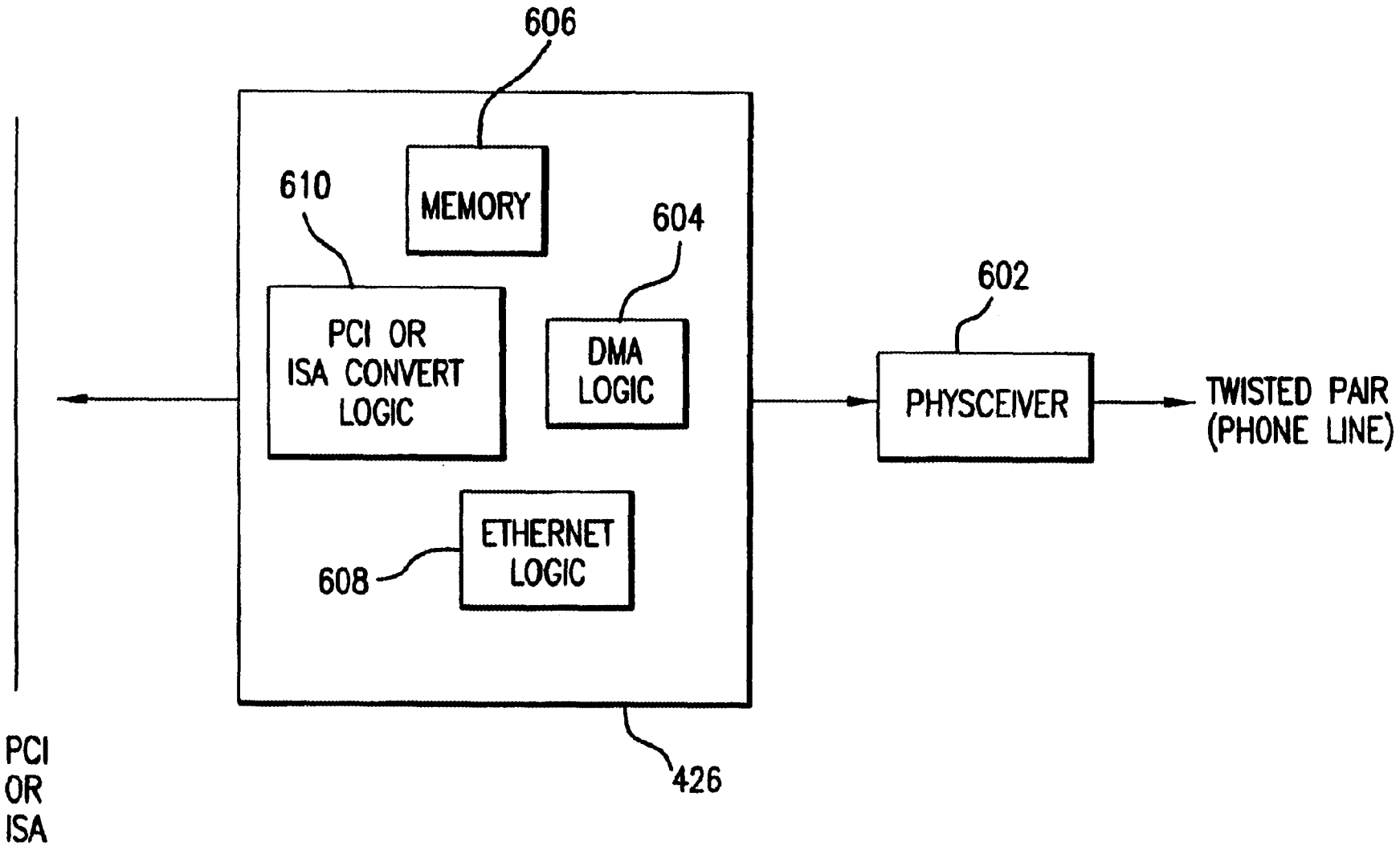
FIG. 12 is a simple schematic view of one possible embodiment of the Internet card of FIG. 10.

FIG. 12 illustrates one possible embodiment of the internet card 426 of FIG. 10. A physceiver 602 is coupled to the phone line to receive the signals from the distant PC 468, and to convert the analog signals from the phone line into digital signals. The digital signals are then provided to the internet card 426. The internet card 426 has a DMA (direct memory access) logic 604 that is responsible for the DMA data transfer, a memory 606 that can operate as a local buffer for storing the data stream from the physceiver 602, and an ethernet logic 608. The internet card 426 also includes a convert logic 610 that converts the digital signals from physceiver 602 to twisted pair cable linear signals that can be used by an appropriate interface in communicating with the PC 24*a*. As shown in FIG. 12, the interface can be either a PCI or ISA interface as is well-known in the art.

FIG. 11 illustrates a second modification that can be made to the PC 24 of FIG. 4. The elements of the PC 24*b* in FIG. 11 that are the same as the elements of the PC 24 of FIG. 4 are provided with the same numeral designations except that an "b" has been added to the numeral designations in FIG. 10, and are not further described herein. The PC 24*b* is the same as PC 24 in FIG. 4 except that a phone card 460 is also coupled to the first bus 424. The phone card 460 is adapted to interface the PC 24*b* with a phone line connection through which information signals can be received and transmitted, and preferably facilitates tone transmission of data. The PC 24*b* therefore allows the user to control the devices 14, 18 and 22 from a distant telephone 470 using a conventional phone line, as described below.

The operation and use of the PC 24*b* is similar to that of PC 24 in FIG. 4. In particular, the PC 24*b* can be "trained", configured or programmed using the same method described above in connection with FIG. 8 using the remote control units 12, 16, 20 and the wireless interface 46, 46*a*. For example, the user can use the command identifier "*2" to represent the turning on of an air-conditioner. This can be especially desirable on a hot day where the user may wish to turn on the air-conditioner before he or she returns home so that the house can be in a cool and comfortable condition to welcome the user. When the user is now outside the home and at a distant location, the user can cause the air-conditioner to turn on by providing a command identifier (see step 902 in FIG. 9). To do so, the user can call the PC 24*a* from a distant telephone 470 and establish a phone link with the phone card 260 of the PC 24*a* (as described below). After the phone link between the distant telephone 470 and the PC 24*b* has been established, the user enters the designated command identifier "*2" from the touch pads of the telephone 470, and the signal for "*2" is transmitted via the phone line to the phone card 460 of PC 24*b*, from which the PC 24*b* can process the signal. In this regard, the phone card 460 also operates in the same way as an input device (such as user input device 40) in receiving the command identifier (see step 904 in FIG. 9). The PC 24*b* then processes the received command identifier in the same manner as described in steps 906, 908, 914, 916, 922 and 924 of FIG. 9.

Figure 13:
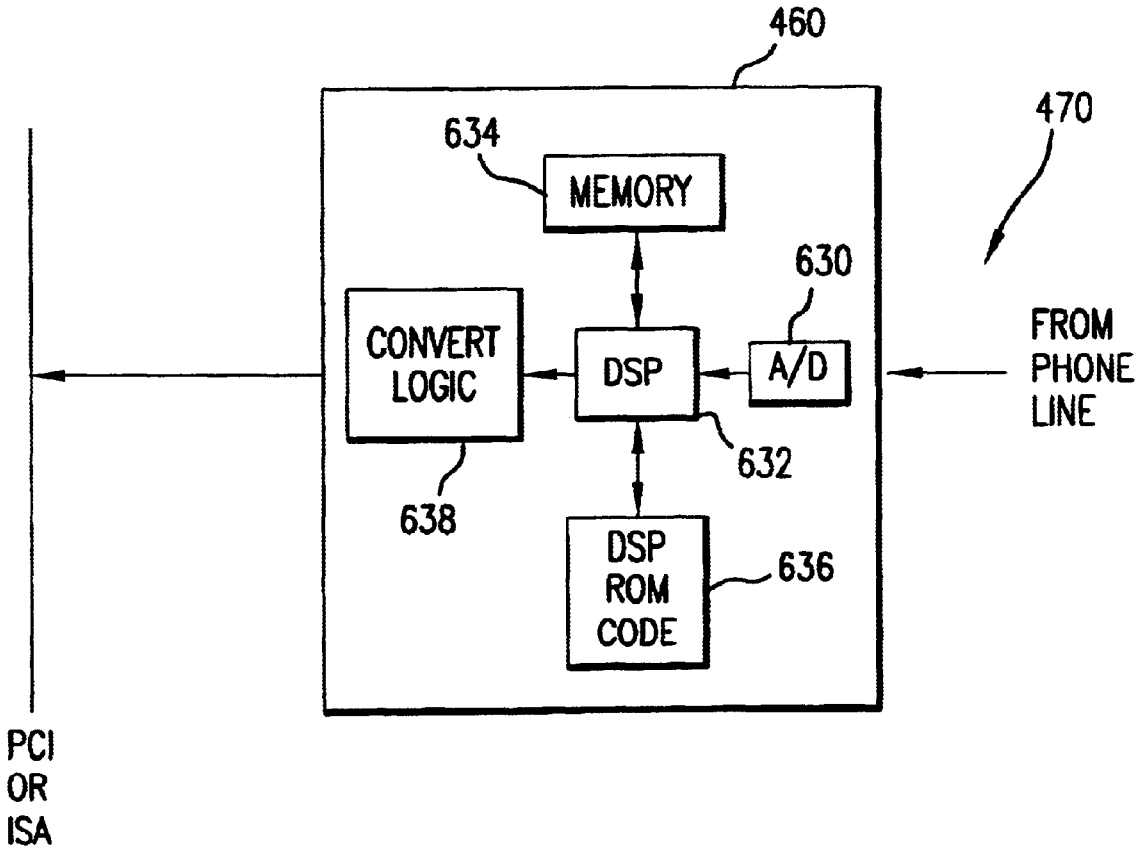
FIG. 13 is a simple schematic view of one possible embodiment of the phone card of FIG. 11.

FIG. 13 illustrates one possible embodiment of the phone card 460 of FIG. 11. The phone card 460 has an analog-to-digital (AD) converter 630 coupled to the phone line to receive the signals from the distant phone 470, and to convert the analog signals from the phone line into digital signals. The digital signals are then provided to a DSP (digital signal processor) 632 which determines whether the incoming signal is a voice or tone signal. The DSP 632 will accept all tone signals, and discard voice signals. The phone card 460 also includes a memory 634 that can operate as a local buffer for storing the data stream from the phone line, and a ROM 636 that stores the DSP code. The phone card 460 also includes a convert logic 638 that converts the digital signals to PCI or ISA signals that can be used by an appropriate interface in communicating with the PC 24*b*. As shown in FIG. 13, the interface can be either a PCI or ISA interface as is well-known in the art.

To operate the embodiments shown in FIGS. 10 and 11, the user can leave the PC 24*a* and 24*b*, respectively, on when he/she is away from the location of the PC 24*a* or 24*b*, so that the PC 24*a* and 24*b* is always connected to the Internet or phone line. A software can be resident in the PC 24*a* and 24*b* to poll the Internet or phone line for incoming calls or signals.

It is contemplated that the present invention can be implemented in software, hardware, firmware or a combination of the above. For example, the present invention can be embodied in a driver application that interacts with an operating system. Alternatively, the present invention can be integrated with the operating system. In an alternative embodiment the present invention can be integrated in a removable PC card.

Thus, the present invention provides systems whereby a PC can be programmed with the codes of certain remote control units so that the PC can store and then re-transmit these signals to control the operation of certain devices associated with these remote control units. The systems of the present invention therefore utilize the PC as a "universal" remote control unit, which addresses the problems relating to the clutter of too many remote control units, as well as increasing the convenience for a user. The systems of the present invention can further create a desired environment in which a plurality of different functions can be triggered by the PC in one or more devices by the push of a single button or command identifier.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A method of remotely controlling a plurality of devices, each device capable of performing at least one function upon receipt of a corresponding code, the method comprising:

(a) providing a plurality of remote control units, each remote control unit exclusively controlling a corresponding one of the plurality of devices via a specific code that is unique to the associated remote control unit; and (b) controlling a first device from the plurality of devices, comprising:

receiving a command identifier for the first device;

receiving a code from one of the plurality of remote control units that is associated with the first device;

associating the received code with the command identifier;

storing the code and associated command identifier into a knowledge base;

transmitting the command identifier from a distant location;

employing the knowledge base to locate the associated code; and transmitting the code from the knowledge base to the first device to control operation of the first device.

2. The method of claim 1, wherein the step of associating the code with the command identifier further includes:

converting the received code into a corresponding data string; and assigning the data string to the command identifier.

3. The method of claim 2, wherein the step of employing the knowledge base to locate the associated code further includes converting the data string associated with the command identifier into an associated code.

4. The method of claim 1, further comprising the step of receiving the transmitted code and re-transmitting the transmitted code.

5. The method of claim 1, wherein the command identifier is provided via an input device.

6. The method of claim 1, wherein the code is transmitted by a computer.

7. The method of claim 6, wherein the code is transmitted by wireless transmission.

8. The method of claim 1, wherein the step of associating the received code with the command identifier includes associating a plurality of codes in a knowledge base to the command identifier.

9. The method of claim 8, wherein the step of transmitting the code from the knowledge base to the device to be controlled includes transmitting the plurality of codes from the knowledge base that are associated with the command identifier.

10. The method of claim 1, wherein the step of transmitting the command identifier from a distant location includes transmitting the code from a distant computer via an Internet link.

11. The method of claim 1, wherein the step of transmitting the command identifier from a distant location includes transmitting the code from a distant telephone via a telephone link.

12. A system comprising:

a plurality of devices, each device capable of performing at least one function upon receipt of a code corresponding to the function;

a plurality of remote control units, each remote control unit exclusively controlling a corresponding one of the plurality of devices via a specific code that is unique to the associated remote control unit;

an input device; and a computer coupled to the input device, the computer having a memory, a receiver which receives codes from the plurality of remote control units, a knowledge base that stores the respective codes transmitted from the remote control units and respective command identifiers provided from the input device, the knowledge base associating each command identifier with a particular code, a transmitter which transmits a code to one of the plurality of devices based on the selected command identifier, and a card coupled to the memory for allowing a communication link from a distant communication device.

13. The system of claim 12, wherein the card is an Internet card and the distant communication device is a distant computer.

14. The system of claim 12, wherein the card is a phone card and the distant communication device is a distant telephone.

15. The system of claim 12, wherein the computer further includes an interface coupled to the receiver, the input device and the knowledge base for receiving the command identifiers and the codes.

16. The system of claim 12, wherein the input device is selected from the group consisting of: a keyboard, a cursor control device, and a graphical user interface.

17. The system of claim 12, further including a display device coupled to the computer for displaying the command identifiers and functions.

18. The system of claim 12, wherein the knowledge base further associates a command identifier to a plurality of codes.

19. The system of claim 12, further including a repeater having a receiver for receiving the codes transmitted from the transmitter of the computer, and a transmitter for transmitting the received codes to a device to be controlled.

20. The system of claim 12, wherein the transmitter is an infrared transmitter, and the receiver is an infrared receiver.

* * * * *